US005178193A

United States Patent [19]

Sato et al.

[11] Patent Number: 5,178,193

[45] Date of Patent: Jan. 12, 1993

[54] MANUFACTURING A LONG BIAS CLOTH FROM A CIRCULAR LOOM BY SPIRAL CUTTING

[75] Inventors: Akihiro Sato, Otsu; Kazuhiro Koshino; Hideyuki Mori, both of Ibaraki, all of Japan

[73] Assignee: Ashimori Kogyo Kabushiki Kaisha, Osaka, Japan

[21] Appl. No.: 460,107

[22] PCT Filed: Jun. 17, 1988

[86] PCT No.: PCT/JP88/00601

§ 371 Date: Feb. 9, 1990

§ 102(e) Date: Feb. 9, 1990

[87] PCT Pub. No.: WO89/12712

PCT Pub. Date: Dec. 28, 1989

[51] Int. Cl.[5] ..... D03D 3/02; D03D 37/00; D03J 1/08

[52] U.S. Cl. ..... 139/291 R; 139/291 C; 139/457; 139/16; 26/82; 28/190; 29/2.13

[58] Field of Search ..... 28/142, 291 C, 157, 28/190; 139/457, 291 R, 16, DIG. 1; 26/82; 66/151, 152, 153; 156/88, 149, 250; 29/2.13

[56] References Cited

U.S. PATENT DOCUMENTS

| | | | |
|---|---|---|---|
| 608,676 | 8/1898 | Herold | 139/16 |
| 704,566 | 7/1902 | Newell | 29/2.13 |
| 1,356,485 | 10/1920 | Bunker . | |
| 3,784,427 | 1/1974 | Griffin | 156/88 X |
| 3,983,720 | 10/1976 | Eschenbach et al. | 66/151 |
| 4,462,431 | 7/1984 | Bosse et al. | 139/457 |

FOREIGN PATENT DOCUMENTS

| | | |
|---|---|---|
| 2175501 | 9/1973 | France . |
| 28-649 | 2/1953 | Japan . |
| 40-2717 | 2/1965 | Japan . |
| 52-85597 | 12/1976 | Japan . |
| 53-126392 | 11/1978 | Japan . |
| 59-22720 | 7/1982 | Japan . |
| 59-22721 | 7/1982 | Japan . |
| 60-118571 | 1/1983 | Japan . |
| 61-13578 | 4/1986 | Japan . |

*Primary Examiner*—Andrew M. Falik

*Attorney, Agent, or Firm*—Birch, Stewart, Kolasch & Birch

[57] ABSTRACT

Continuous production of a long bias cloth is accomplished by manufacturing a tubular fabric on a circular loom having a circular frame, reeds arranged on the frame and a shuttle for a weft rotatable along the frame. The fabric is removed from the loom under tension by a removal device comprising a primary pillar core with a plurality of caterpillars adjacent its outer periphery. Removal under tension prevents the formation of any edge portion causing folds and wrinkles in the tubular fabric. The tubular fabric is then spirally cut by a cutting device which has a secondary pillar core with a plurality of feed rolls adjacent its outer periphery. The feed rolls are capable of moving the fabric forward relative to its length, while the cutter is capable of moving circumferentially relative to fabric lengbth. A long bias cloth of high quality can be manufactured continuously, even when the warp and weft fibers used have high-strength and poor or low elongation.

20 Claims, 8 Drawing Sheets

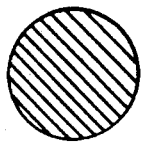
FIG. 3A(1)
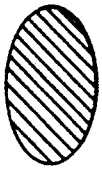
FIG. 3B(1)
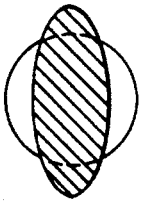
FIG. 3C(1)
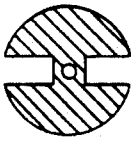
FIG. 3D(1)
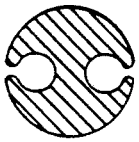
FIG. 3E(1)
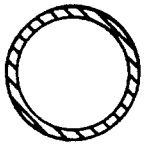
FIG. 3A(2)
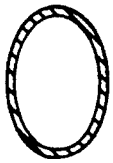
FIG. 3B(2)
FIG. 3A(3)
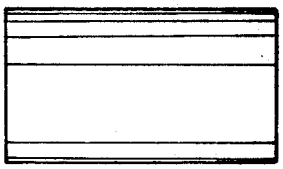
FIG. 3B(3)
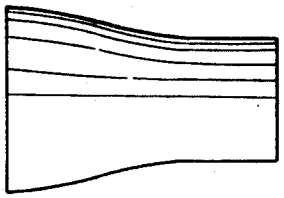
FIG. 3C(2)
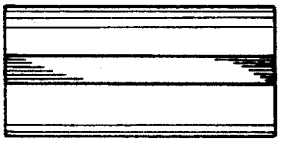
FIG. 3D(2)
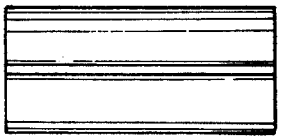
FIG. 3E(2)

MANUFACTURING A LONG BIAS CLOTH FROM A CIRCULAR LOOM BY SPIRAL CUTTING

FIELD OF THE INVENTION

This invention relates to a method and apparatus for continuously manufacturing a bias cloth which is useful directly as textile materials and industrially for belt, duct and structural materials for ships and aircrafts such as FRP, ACM (advanced composite material) and like reinforced materials when impregnated with a resin. More particularly, the present invention relates to a method and apparatus for continuously manufacturing a long bias cloth by continuously carrying out the steps of manufacturing a tubular fabric with a circular loom, taking out the tubular fabric from the circular loom under tension while preventing the formation of edge portions forming folds and wrinkles, etc., and spirally cutting the tubular fabric while holding it in tension.

DESCRIPTION OF PRIOR ART

The term bias cloth means a cloth wherein the yarns thereof are oriented on the diagonal relative to the length of the cloth. As bias cloth has a diagonal fibrous structure, it is distinguished by its bending-fatigue-resistance and curved surface-fitting property. Thus, a bias cloth made of synthetic fibers is suitable as textile material and is used for the manufacture of V-belts, ducts, bellows-hoses, etc. as a processed material impregnated with rubber or a synthetic resin. A bias cloth made of a yarn manufactured from fibers of high strength such as aramide fibers, glass fibers and carbon fibers is impregnated with a resin to form a reinforced material such as FRP or ACM, which materials have found increased utility in recent years as structural materials for ships, aircrafts, etc. or as sporting goods where strength is required. This bias cloth has been manufactured by diagonally cutting a cloth ordinarily woven with warps and a weft. However, a long bias cloth cannot be obtained according to this diagonal cutting method.

A long bias cloth can be obtained from, a tubular fabric woven by a circular loom and cut spirally, as disclosed, for example, in Japanese Laid-open Patent Appln. No. Sho. 59-22720 and Japanese Laid-open Patent Appln. No. Sho. 59-22721. According to the invention disclosed in Japanese Laid-open Patent Appln. No. Sho. 59-22720, a cylindrical core is inserted into a tubular fabric woven by a circular loom to adjust the configuration and density of warps and a release paper carrying a matrix resin film is bonded to the tubular fabric, which is then cut spirally in the lengthwise direction to obtain a bias prepreg. In Japanese Laid-open Patent Appln. No. Sho. 59-22721, there is disclosed a process for manufacturing a bias prepreg wherein a tubular fabric is cut spirally, along its lengthwise direction, for example, at an angle of 45°. Prior to this cutting, the part to be cut out is fixed with a gum tape or the like. After cutting, cut out portion is fixed and then impregnated with a matrix resin. In Japanese Utility Model Publn. No. Sho. 61-13578, there is disclosed an apparatus for facilitating cutting of a tubular fabric in the spiral direction by marking the tubular fabric with a marking material moving perpendicular to the lengthwise direction of the tubular fabric while weaving on circular loom.

The methods and apparatus disclosed in these publications basically show the production of a bias cloth having a substantially unlimited length by cutting a tubular fabric spirally. These methods and apparatus can be applied to a tubular fabric woven with widely used synthetic yarns such as nylon, polyester, vinylon and like fiber yarns; but these methods and apparatus are not applicable to a tubular fabric woven with the above mentioned fibers of high strength, such as carbon fibers for manufacturing a bias fabric. In the above mentioned Japanese Laid-open Patent Appln. Nos. Sho. 59-22720 and 22721, for example, there is disclosed that a tubular fabric is woven so as to have a hollow weaving structure with an ordinary loom. However, when a tubular fabric is woven according to the hollow weaving method with a yarn of high strength fibers, strong tension is applied to the yarn on reverse movement of a weft at the edge portions. As the elongation of the yarn is poor, the fibers cannot be reversed partially in that place and therefore project externally to become fluffy. Moreover, slipping of yarns takes place in the fabric structure makes warp density uneven. Even when a tubular fabric is woven with a circular loom, the tubular fabric is flattened between the step of taking it out until the step of spirally cutting it out, as shown in FIG. 2 of Japanese Laid-open Patent Appln. Sho. 59-22720. The so that the tubular fabric thus flattened by subjecting to calendering is strongly pressed on both sides to form edge portions where the weft becomes twisted or the slippage takes place. In the method disclosed in Japanese Utility Model Publn. No. Sho. 61-3578, as shown in FIG. 4, a tubular fabric just after being taken out from a circular loom retains a cylindrical tubular form so that the edge portions are not formed and there is no problem of slippage. After the tubular fabric has been marked spirally with a cutting line, however, the tubular fabric is folded into flattened state so that the edge portions are then formed and problems of fluffing of fibers, wrinkles and slippage take place.

Further, the invention, for example, of Japanese Laid-open Patent Appln. Nos. Sho. 60-118571 and 52-85597 and in U.S. Pat. Nos. 3,832,210 and 4,299,878 disclose as the conventional methods and apparatus for manufacturing bias cloth. However, these methods and apparatus have a number of drawbacks including the above mentioned drawbacks such as fluffing, slipping, and uneven ward density in the edge portions and so cannot be applied to a continuous production of a long bias cloth, especially made of fibers having high strength such as carbon fiber. In Japanese Laid-open Patent Appln. No. Sho. 60-118571, there is disclosed an improved technique for manufacturing a bias cloth by cutting an ordinary cloth with a bias cutter wherein a special conveyor belt is used to shorten the cutting cycle of the bias cutter thereby improving the producibility. As is evident from the apparatus shown in FIGS. 1-3 of JP 60-118571 however, this method cannot produce a long bias cloth continuously. In Japanese Laid-open Patent Appln. No. Sho 52-85597, there is disclosed an apparatus wherein a tubular fabric folded multiple times without tension in a tray is supplied to multiple cutters while being rotated with a cylinder. The cut bias strips are wound around multiple rolls. According to this apparatus, multiple bias strips can be manufactured at one time from one tubular fabric, and these bias strips can be used directly for hemming for textile materials. According to this apparatus, the tubular fabric starting material is of a limited length, manufactured batch-wise so that extremely long bias strips cannot be manufactured but those of a sufficient length for use as textile materials can be manufactured. In this apparatus wherein the tubular fabric is cut by a plurality of cutters, a wide bias cloth cannot be manufactured. Even if a single cutter is used for manufacturing a bias cloth, there are still the following drawbacks: When the tubular fabric is folded without tension, wrinkles in the tubular fabric, distortion of fibers and unevenness of density take place owing to this folding, and furthermore, fluffing or the like phenomenon takes place depending upon the type of fibers. Moreover, a bias cloth cannot be manufactured continuously by supplying a tubular fabric continuously to the apparatus U.S. Pat. No. 3,832,210 discloses a method for manufacturing a bias cloth by spirally cutting a tubular fabric made according to the hollow weaving method, wherein the width S of the tubular fabric a folded state and the width W of the cloth measured between the spiral cut lines on the tubular fabric are so adjusted that the cut bias cloth forms only one edge portion at any point in a transverse direction. Thereafter, calendering the bias cloth together with a flexible elastomeric material to stretch the cloth in a lengthwise direction improves the state of the edge portions. In this method, of formation edge portions in the bias cloth is unavoidable. The edge portions, where the density of fibers is uneven and wrinkles are formed, can be improved more or less in the stretching treatment of fibers but cannot be eliminated entirely. Further, there is a shortcoming that the fibers of inorganic nature cannot be thermoset by calendering. In U.S. Pat. No. 4,299,878, there is disclosed a method and apparatus wherein a woven tubular fabric is immediately passed through tension bars 40, 41 in a folded and flattened state and then through off-set rolls 11, 12 to take up the tubular fabric without slippage at both ends, and the tubular fabric is cut to manufacture a uniform bias cloth and bound with a removable adhesive backing sheet. However, the description of this specification fails to give a concrete explanation therefor; it is not clear how the tubular fabric is cut and how the tubular fabric is taken up without slippage at both ends. Even if both sides of the flattened tubular fabric become uniform, the tubular fabric in a flattened state is taken up under tension so that the edge portions are also strongly pressed by rolls, thereby making it unavoidable that wrinkles, unevenness in density and distortion take place in these portions.

In methods and apparatus known hitherto for manufacturing a bias cloth, fluffing, distortion of fibers and slippage of yarns in the edge portions cannot be prevented as mentioned above so that the structure of the bias cloth formed is not uniform. Even if this bias cloth is impregnated with a resin to form a prepreg or reinforcing materials such as FRP and ACM, satisfactory products cannot be obtained. In case of FRP and ACM utilized as structural materials for ships and aircrafts, the use of carbon fibers having high strength is most suitable for the manufacture of a bias cloth as basic material. However, the problems in the edge portions as seen in the conventional methods become serious in case of using carbon fibers. Thus, it is almost impossible in the conventional methods and apparatus to obtain a bias cloth made of carbon fiber excellent in performance. Moreover, the current status is that a method and apparatus for continuously manufacturing a bias cloth by weaving a tubular fabric from warps and a weft and immediately cutting the tubular fabric spirally without raising any problem in the edge portions thereof has not yet been completed in the prior arts.

Under the above circumstances, a method and apparatus for continuously manufacturing a bias cloth of uniform quality from a tubular fabric which is manufactured from warps and a weft made of high strength fibers such as carbon fiber in addition to ordinary natural and synthetic fibers is greatly demanded by those skilled in the art.

SUMMARY OF THE INVENTION

Accordingly, it is an object of the present invention to provide a method for continuously manufacturing a bias cloth starting from yarns made of various kinds of fibers.

It is another object of the present invention to provide a method for continuously manufacturing a long bias cloth by cutting a tubular fabric without forming any edge portions thereby overcoming all of the drawbacks as seen in the prior art.

It is still another object of the present invention to provide a method for manufacturing a long bias cloth in a series of continuous steps which comprise manufacturing a tubular fabric from yarns made of fibers of high strength and poor or low elongation without forming any fluffing of the fibers, and then cutting the tubular fabric.

It is further object of the present invention to provide an apparatus for continuously manufacturing a long bias cloth which comprises a device for manufacturing a tubular fabric in combination with a device for spirally cutting the tubular fabric.

It is a further object of the present invention to provide an apparatus for continuously manufacturing a long bias cloth which comprises a circular loom and a warp-supplying device capable of manufacturing a tubular fabric from yarns made of fibers of high strength and poor or low elongation without any damage.

BRIEF DESCRIPTION OF THE DRAWINGS

Other objects and advantages of the present invention will become apparent from the following description and figures in which:

FIG. 3A(1), 3A(2) , and 3A(3) illustrate the shape of the pillar core of the prevent invention;

FIG. 3B(1), 3B(2), and 3B(3) shows an alternative to the shape shown in FIG. 3A(1), 3B(2), and 3A(3) of the pillar core of the present invention;

FIG. 3C(1) and 3C(2) shows an alternative to the shape shown in FIG. 3A(1), 3A(2), and 3A(3) of the pillar core of the present invention;

FIG. 3D(1) and 3D(2) shows an alternative to the shape shown in FIG. 3A(1), 3A(2), and 3A(3) of the pillar core of the present invention;

FIG. 3E(1) and 3E(2) shows an alternative to the shape shown in FIG. 3A(1), 3A(2) and 3A(3) of the pillar core of the present invention;

DETAILED DESCRIPTION OF THE PREFERRED EMBODIMENTS

Figure 1:
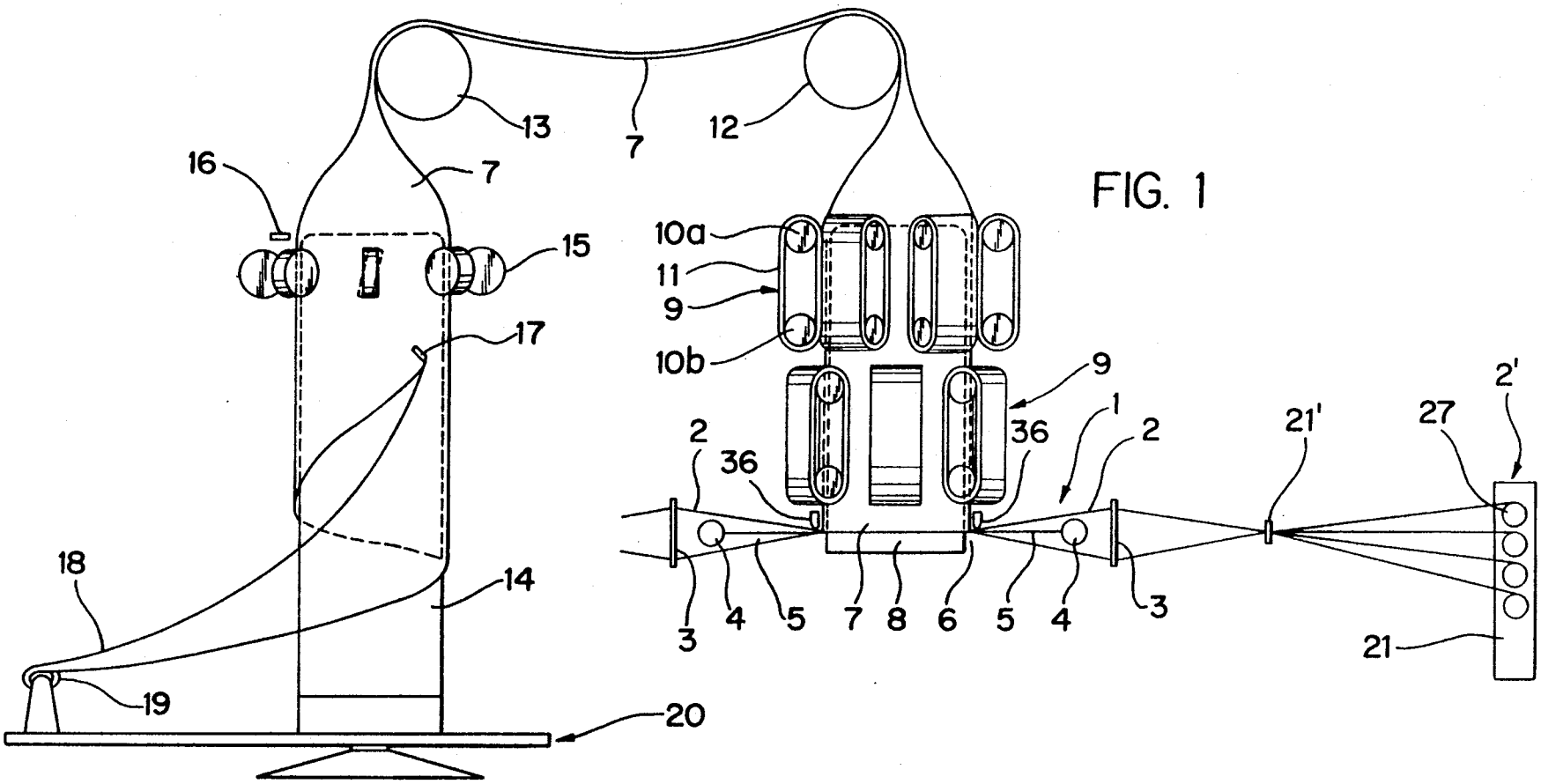
FIG. 1 illustrates a first embodiment of the present invention wherein the manufacture of the tubular fabric and the manufacture of the bias cloth are carried out on different axes.

The difficulties in the prior art, such as fluffing, distortion of yarns, unevenness in density and slippage, are all overcome by forming a tubular fabric from warps and a weft with a circular loom, taking out the tubular fabric from the loom under tension without flattening while maintaining its cross section as circular or elliptical, and immediately spirally cutting the tubular fabric in such without forming any edge portions. It has also been found that even if the tubular fabric taken out in such state is moved without tension into a flattened state, a bias cloth overcoming the above mentioned drawbacks can be obtained continuously by reforming the cross section of the tubular fabric as circular or elliptical on spirally cutting the tubular fabric. It has further been found that even if yarns of high strength and poor or low elongation are used, fluffing of the tubular fabric can be prevented by imparting tension to warps supplied to a circular loom and/or making a special device for the movement of a shuttle of the circular loom.

In accordance with a first embodiment of the present invention, there is provided a method for continuously manufacturing a long bias cloth which comprises forming a tubular fabric by weaving warps and a weft with a circular loom and then cutting the tubular fabric spirally, characterized in that the tubular fabric is taken out under tension from the circular loom while maintaining the cross section thereof circular or elliptical and allowed to advance in lengthwise direction on the same axis or a different axis from the central axis of the circular loom while maintaining the cross section thereof circular or elliptical and simultaneously cutting the tubular fabric spirally by means of a cutter moving in a circumferential direction in transverse to the axis.

In accordance with further details of the present invention, there is provided an apparatus for continuously manufacturing a long bias cloth which comprises (a) a warp-supplying device, (b) a circular loom for the manufacture of a tubular fabric provided with a circular frame, reeds arranged on the frame and a shuttle for a weft rotatable along the frame, and (c) a cutting device provided with a cutter capable of cutting the tubular fabric spirally, characterized in that the circular loom is provided between the path of the shuttle formed along the frame and the opening path for the warps with a supporting panel for the shuttle and is provided in a position taking out the tubular fabric with a tubular fabric taking-out device comprised of a primary pillar core arranged on the same axis as the central axis of the circular loom and one or more taking-out caterpillars arranged adjacently to the outer periphery of the primary pillar core, and that the cutting device is installed on the same axis as or a different axis from the axis of the circular loom, and the cutting device is provided with a secondary pillar core, feed rolls adjacent to the outer periphery thereof and is capable of moving the tubular fabric forward in the lengthwise direction and has a cutter capable of moving in circumferential direction transverse to the lengthwise direction of the tubular fabric.

The present invention provides a technique not seen in the prior arts, particularly in that a long bias cloth which is devoid of drawbacks as seen in the conventional bias cloth can be manufactured continuously starting from yarns as material.

It is one of the features of this inventions that the primary and the secondary pillar cores are arranged on the central axis of the circular loom and the cutting device. These pillar cores may be arranged on the same axis or may be arranged on the different axes. If these pillar cores are arranged on same axis, these may integrally be combined. The pillar cores show a cross section in the form of a circle or ellipse and have an outer circumferential length slightly shorter than the inner circumferential length of the woven tubular fabric. The tubular fabric is prevented from being flattened due to this pillar core and thus no edge portions are formed.

It is another feature of the present invention that on taking out the tubular fabric from the circular loom without the formation of any edge portions by the aid of the primary pillar core, at least two stages of the taking-out devices are installed which are provided with a plurality of caterpillars in contact with the outer circumference of the primary pillar core. The primary pillar core and the taking-out devices are combined together to construct the tubular fabric-taking out device which can take out the tubular fabric from the circular loom under tension without forming any edge portions.

It is still another feature of the present invention that a device for preventing warps from loosening and for imparting tension to the warps is added to the warp-supplying device. Fluffing of yarns made of fibers of high strength and poor or low elongation can be prevented by imparting tension to the warps to be supplied to the circular loom. Thus, this tension-imparting device may be omitted when of using yarns made of ordinary synthetic fibers as warps.

It is further feature of the present invention that a plurality of supporting panels are provided between the path of the shuttle formed along the circular frame in the circular loom and the opening path for the warps, whereby the shuttle is driven while being supported by the supporting panels to prevent contact of the rotating shuttle with the warps supplied. If the warps are brought into contact with the rotating shuttle, friction takes place to make them fluffy and to impart strong tension to them. Accordingly, this phenomenon becomes significant when using yarns of high strength and poor or low elongation so that the quality of the resultant bias cloth is deteriorated. The use of the supporting panels is indispensable for maintaining the quality of the bias cloth.

In the method and apparatus of the present invention, these features are effectively combined to enable the continuous manufacture of a bias cloth from yarns.

The warps and the weft used in the present invention as starting materials are usually of the same kind but may be different from each other. In general, these yarns may be commercially available ones and can be used according to the purpose aimed at. These yarns are made of natural fibers such as cotton, silk, and hemp or synthetic fibers, for example, rayon, polyamide such as nylon, polyester, polyurethane, and aramide. The yarns may be the one using inorganic fibers such as glass fiber, carbon fiber and metal fiber. The use of highly strong aramide fiber, carbon fiber and glass fiber is preferable for FRP, ACM, etc. If necessary, a mixed yarn of these fibers maybe used.

The primary and secondary pillar cores used in the present invention are preferably made of a resin or metal. For example, a cylinder made of stainless steel can be used. In general, the shape is cylindrical but optionally it may be ellipsoidal. The shape may gradually be changed from cylindrical to ellipsoidal. The shape of the primary pillar core may be changed, from that of the secondary pillar core. For example, the shape of the primary pillar core is cylindrical and that of the secondary pillar core may be ellipsoidal or vice versa. The size of the pillar cores is desirably such that its outer circumferential length is slightly shorter than the inner circumferential length of the tubular fabric. Considering the diameter of the tubular fabric, etc., the length of the pillar cores is properly determined, but is generally longer than the diameter of the tubular fabric. These pillar cores are coated all over the surface thereof with a fluorine resin to reduce the contact resistance with the tubular fabric thereby making the movement of the tubular fabric smooth. It is a technical effect of these pillar cores to maintain the cross section of the tubular fabric circular or elliptical thereby preventing the formation of edge portions.

Figure 2:
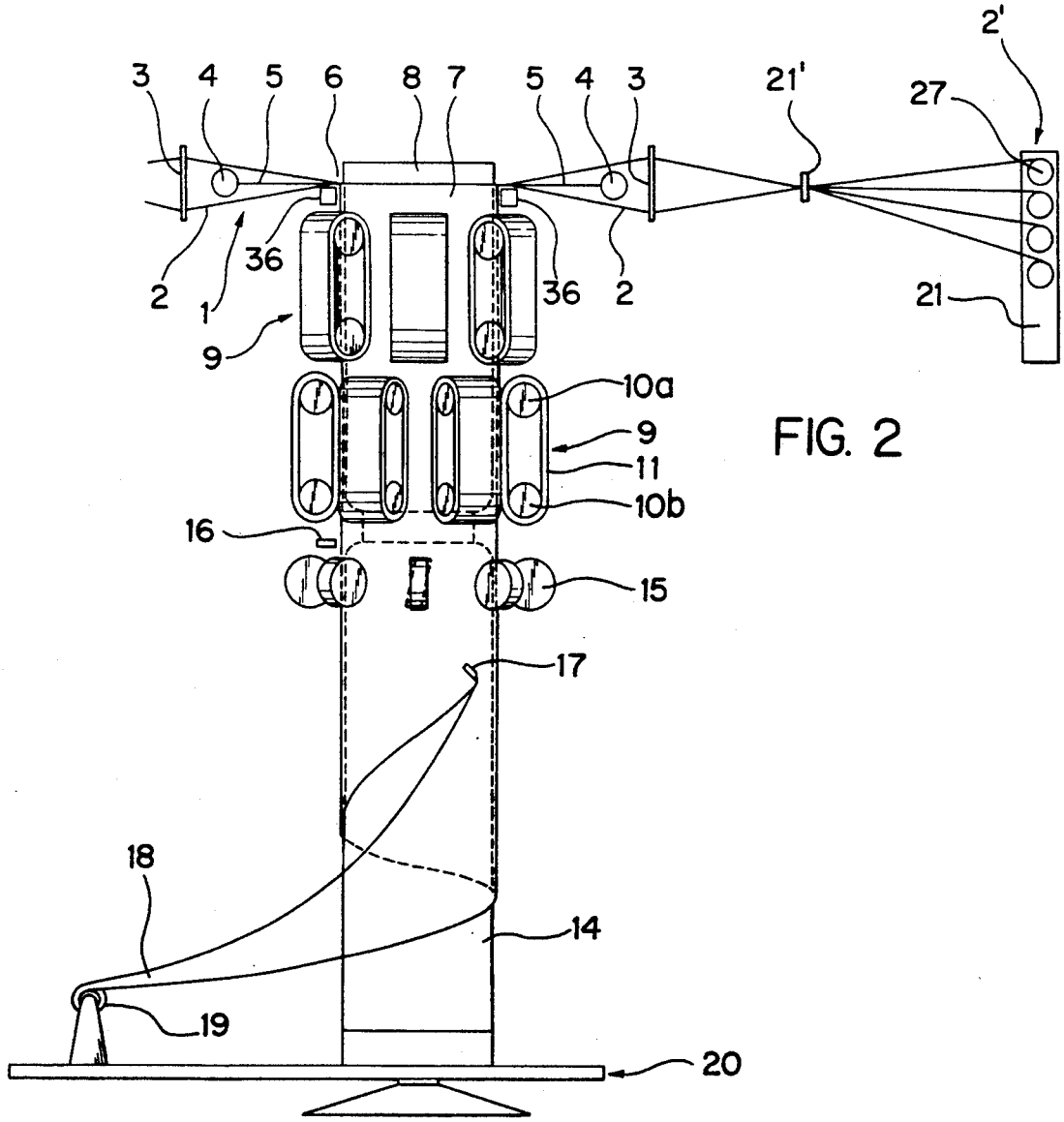
FIG. 2 illustrates a second embodiment of the present invention wherein the manufacture of the tubular fabric and the manufacture of the bias cloth are carried out an on the same axis.

The present invention is roughly classified into two portions, the portion for manufacturing a tubular fabric from yarns, and the portion for manufacturing a bias cloth from the tubular fabric. In the first embodiment of this invention, both portions are carried out, as shown in FIG. 1 on different axes. In the second embodiment of this invention, both portions are carried out, as shown in FIG. 2, on the same axis. In case of the second embodiment, it is convenient that the devices for both portions can continuously be operated at a single place, but as a result the apparatus becomes locally larger and increases its capacity. According to the first embodiment, both portions are carried out separately, but this mode is advantageous in the aspect of the capacity being smaller. Further, handling of the portions becomes easier.

In the first mode of this invention shown in FIG. 1, warps 2 are taken out from bobbins 27 in creels 21 of the warp-supplying device 2' and supplied to a circular loom 1 through guides 21' and heald 3. Between the warps 2 opened by the heald 3 a shuttle 4 of the circular loom 1 is rotated whereby a weft 5 from the shuttle 4 is supplied to cloth fell 6 at the lower portion of cloth fell ring 36 to manufacture a tubular fabric 7 continuously by circular weaving.

A primary pillar core 8 is placed inside of cloth fell 6 of the circular loom 1. The pillar core 8 is located at its one end inside of the cloth fell 6 and is elongated upward. The tubular fabric 7 is stretched upward along the outer surface of the pillar core 8, as covering it therewith. At least one stage (two stages in FIG. 1) of a taking-out or take-up device 9 is installed which is provided with a plurality of caterpillars adjacent to outer periphery of the pillar core 8. Each caterpillar has a pair of rolls 10*a*, 10*b* and a belt 11 connecting the rolls, while the taking-out device 9 usually has 4–8 caterpillars. When multiple taking-out devices 9 are used, the caterpillars at each stage are preferably arranged not on the same axis in the lengthwise direction but on the axis somewhat removed in the transverse direction so that the tubular fabric 7 may be brought into contact over the whole periphery thereof with the belts 11 of the caterpillars. The belts of the caterpillars are rotated by driving the taking-out device 9 whereby the tubular fabric 7 is moved upward by friction over the whole periphery thereof uniformly under tension.

In an example shown in FIG. 1, the tubular fabric 7 woven in the circular loom was moved upward by the taking-out device 9. Alternately, the tubular fabric 7 woven in the circular loom 1 may be moved downward under tension by means of the taking-out device 9.

The tubular fabric 7 is then moved to the position aside the circular loom 1 by guide rolls 12 and 13. On passing the guide rolls 12 and 13, the tubular fabric 7 which had been expanded to a shape similar to the pillar core 8 in cross section is flattened slightly. However, the guide rolls 12 and 13 are rotated lightly and no tension is applied to the tubular fabric 7 between the guide rolls so that the tubular fabric is hung in a loosened state without forming any edge portion by being completely flattened.

Beneath the guide roll 13, a secondary pillar cove 14 which may be the same or different from the primary pillar core 8 is provided to re-expand the tubular fabric 7 passed over the guide roll 13. Above the secondary pillar core 14, a plurality of feed rolls 15 are adjacently provided in compliance with the shape of the outer periphery of the secondary pillar core 14 so that they are brought into contact with the tubular fabric 7 moving along the secondary pillar core 14. The feed rolls 15 are allowed to abut against the outer surface of the tubular fabric 7 and rotated parallel to the axis of the secondary pillar core 14 whereby the tubular fabric 7 is moved downward along the outer surface of the secondary pillar core 14. A sensor 16 adjacent to the feed rolls 15 detects any distortion of the tubular fabric 7 and tilts the rotation axis of the feed rolls 15, as shown by a dotted line in FIG. 1, in accordance with the distortion. Thereby the tubular fabric 7 is moved downward obliquely to correct its distortion. Usually, however, the tubular fabric 7 is not twisted.

A cutter 17 is installed outside of the tubular fabric 7, in a manner similar to that as shown in FIGS. 1 and 3 of U.S. Pat. No. 1,356,485 to Bunker, and is moved in the direction perpendicular to the direction of the downwardly moving tubular fabric 7, or in other words, the cutter is moved in a horizontal direction along the outer periphery of the tubular fabric 7 to cut it spirally. To obtain a bias cloth which is 45° biased against the original fabric, the moving velocity of the cutter is equal to the downwardly moving velocity of the tubular fabric 7. Bias cloth in this shape is usually used most advantageously. If desired, the moving velocity of the cutter may be freely varied to the downwardly moving velocity of the tubular fabric 7 to obtain a bias cloth having a different bias angle. In FIG. 1, the tubular fabric 7 is cut while being moved downwardly. It is possible, however, to arrange the secondary pillar core 14 above the guide rolls 13 and to cut the tubular fabric 7 while it is being moved upwardly. Further, the cutter 17 may be concealably installed in the secondary pillar core 14 and the pillar core 14 provided with the cutter 17 alone may be allowed to rotate to cut out the tubular fabric internally.

The bias cloth 18 obtained by cutting the tubular fabric 7 spirally is wound on a reel 19. As the descending tubular fabric 7 is cut spirally by the cutter 17 rotating in the peripheral direction thereof, the bias cloth to be wound on the reel 19 is spirally twisted so that it cannot be wound as such on the reel 19. Accordingly, the reel 19 is installed on a turntable 20 and rotated around the secondary pillar core 14 as a center at the same velocity as the cutter moving in horizontal direction whereby the resultant bias cloth 18 can be wound on the reel 19 without being twisted. The central part of the turntable 20 is cut off and in this vacant place the secondary pillar core 14 is supported on the base so that the secondary pillar core 14 itself is not rotated. In this manner, the bias cloth 18 can continuously be obtained from the warps 2 and the weft 5 as the starting materials and has a substantially unlimited length.

In the second mode of the present invention shown in FIG. 2, the warps 2 are taken out from the bobbins 27 of the warp-supplying device 2' and supplied through the guide 21' to the circular loom 1 having the primary pillar core 8 on its center. Between the warps 2 opened by heald 3, the shuttle 4 of the circular loom 1 is rotated to supply the weft 5 therefrom to the cloth fell 6 above the cloth fell ring 36 whereby the warps and the weft are woven to form a tubular fabric 7. The weaving method in this case is same as in the case of the first mode of this invention as shown in FIG. 1.

In an example shown in FIG. 2, the circular loom for the manufacture of the tubular fabric 7, the primary pillar core 8 and the secondary pillar core 14 are arranged on the same axis. In this case, too, at least one stage (two stages in FIG. 2) of the taking-out device 9 which comprises a plurality of caterpillars, usually 4–8 caterpillars having a pair of rolls, 10*a* and 10*b* and a belt 11 connecting these rolls is brought into contact with the outer periphery of the tubular fabric 7 parallel to the axis of the primary pillar core 8. The arrangement of multiple taking-out devices 9 is same as in the case of FIG. 1 so that the tubular fabric 7 may be contacted over its whole surface with the belts 11 of the caterpillars. The tubular fabric is uniformly pulled down under tension by driving the taking-out device and the tubular fabric then descends along the outer periphery of the secondary pillar core 14, as in case of FIG. 1, by the aid of the feed rolls 15. As shown in FIG. 1, the sensor 16 adjacent to the feed rolls 15 corrects any distortion of the tubular fabric 7, as shown by a dotted line in FIG. 2, by tilting the rotation axis of the feed rolls 15 if the tubular fabric 7 is twisted. As shown in FIG. 1, the tubular fabric 7 is cut by means of the cutter 17 to manufacture the bias cloth 18, which is then wound on the reel 19.

In this second mode of the present invention, the primary pillar core 8 and the secondary pillar core 14 are arranged on the same axis. Accordingly, these pillar cores are separately installed on the same axis or may be combined into one pillar core. FIG. 2 shows an example of manufacturing the bias cloth 18 by downward movement the tubular fabric 7 manufactured by the circular loom 1. However, it is also possible to manufacture the bias cloth by moving the tubular fabric upwards. The arrangement of the apparatus in this case is a vertically reversed from the one shown in FIG. 2.

FIGS. 3A–E are cross sections and longitudinal cross sections of the typical 4 kinds of the pillar cores for maintaining the tubular fabric in an expanded state. FIG. 3A shows the pillar core being a solid or hollow cylindrical form. FIG. 3B shows the pillar core being a solid or hollow ellipsoidal form. FIG. 3C shows the pillar core being a combination of the cylindrical and ellipsoidal forms, with the upper part being an ellipsoidal form, but this may be vertically reversed form. In FIGS. 3B and 3C, an oval form which is a somewhat deformed elliptical form is considered to be a variation of an ellipse, and so a solid or hollow pillar core of an oval form in cross section is also involved in the category of ellipsoid in the present invention. As the pillar cores function to make the tubular fabric circular or elliptical in cross section, deformed pillar cores may also be used so far as they function as above. In an example shown in FIG. 3D, hemicylindrical forms are combined to enable the cross section of the tubular fabric to be ellipsoidal. FIG. 3E shows a cylindrical form a part of which has been cut out. Such forms can be regarded as pillar cores having a circular or elliptical form in cross section.

The primary and secondary pillar cores may be same or different in shape and can be in any shape as shown in FIGS. 3A–3E. The shape which is easy to make and preferable is a cylindrical form as shown in FIG. 3A. The materials used for these pillar cores are preferably metals, for example, stainless steel, and copper alloys. However, a resinous material and a ceramic material can also be used.

When the warps used in the present invention are ordinary natural or synthetic fibers such as cotton, nylon and polyester, the yarns have a relatively good elongation so that the yarns can be taken out from the bobbins 27 supported by creels 21 of the warp-supplying device 2' and directly supplied to the circular loom 1. In this case, tension necessary for weaving is imparted to the warps by weight tension due to dancing levers or weights in the course of supplying the warps to the circular loom. In case of using the above mentioned yarns of poor or low elongation such as carbon fiber, glass fiber, aramide fiber, metal fiber, etc. as warps, however, it is difficult to impart a proper tension to the warps by the dancing levers and weights tension.

In general, a fabric is woven by separating warps up and down with a heald, and passing a shuttle through the opened warps to supply a weft. This basic weaving principle is the same in the circular loom. In the opening movement of the warps, however, the route of the warps is different in the state of the warps being opened from the route in the state of the warps being closed, so that the length of the warps passing through the route varies with the lapse of time. When ordinary natural fibers or synthetic fibers are used the yarns are more or less stretchable and so the change in length of the yarns caused by the opening of the yarns can fully be absorbed by the elongation of the yarns. Accordingly a proper tension can be imparted to the yarns merely by locally supporting the warps with the weights tension. Further, the warps are not loosened closed.

When the warps have poor or low elongation, however, it is impossible to impart tension to the yarns themselves, and so the change in length of the warps due to the difference of the route by the opening of the warps cannot be absorbed by tension. Therefore, the yarns are loosened and create friction with the loom and or are caught by the loom, such loosening of the yarns can often be corrected by the dancing levers. On passing the warps through the dancing levers, however, the warps are bent at an acute angle at the tip of the dancing levers and supporting levers in the front or rear thereof so that the warps are passed through these levers with much friction. The yarns of poor elongation are usually subject to damage by to friction and therefore become fluffy when thus passed through the dancing levers. Accordingly, it is not preferable that the yarns be thus damaged. In case of using warps of poor or low elongation, therefore, it is desirable that the creels to which the bobbins are mounted are so improved that on taking out the yarns from bobbins, a proper back tension is imparted to the yarns to prevent the warps from loosening and to supply the warps under a moderate tension to the loom.

Figure 4A:
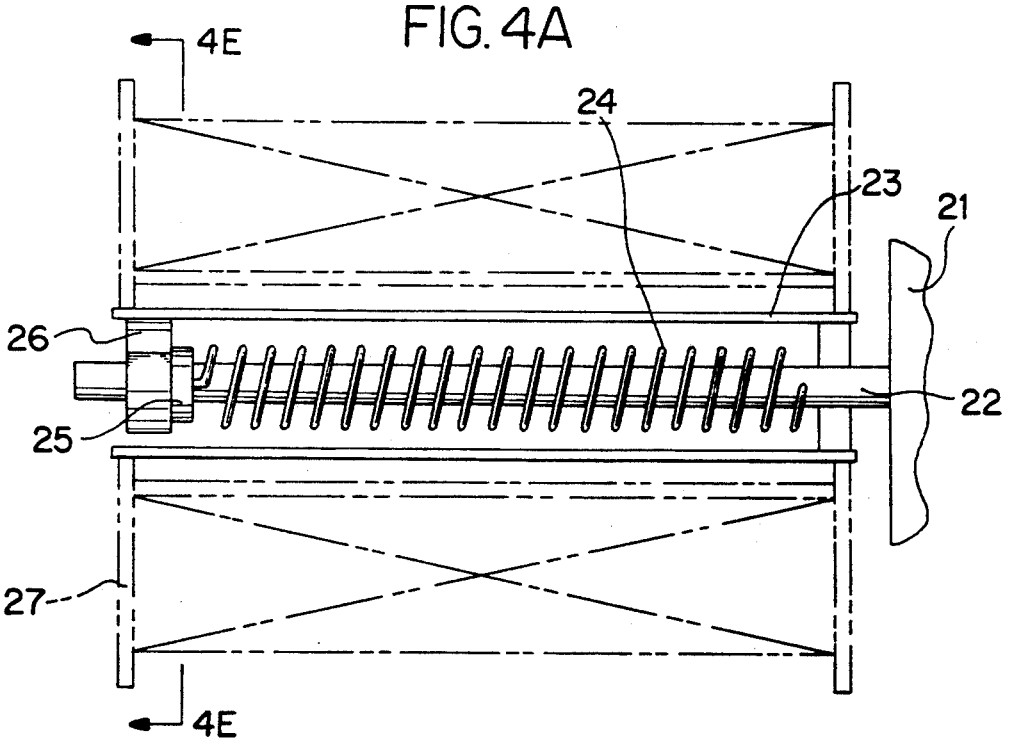
FIG. 4A illustrates the warp-supplying device of the present invention.
Figure 4E:
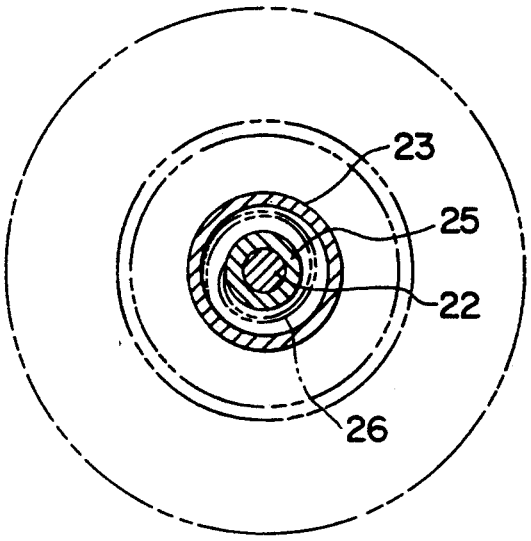
FIG. 4E is a crosssection view along line 4E—4E in FIG. 4A.

FIG. 4A is a longitudinal cross section of an example of the device for supplying the warps to the circular loom under tension. FIG. 4E is as a cross section of the device cut along the line 4E—4E. The creel 21 of the warp-supplying device 2' is provided with, a number of shafts 22 and a sleeve 23 is mounted rotatably to each shaft.

A twist spring 24 is inserted between the shaft 22 and the sleeve 23 and is fixed on one end thereof to the shaft 22 and on the other end to a supporter 25 which is mounted rotatably to the shaft 22. A flat spring 26 is mounted on its inner end onto the outer periphery of the supporter 25 and abuts on the other end against the inner surface of the sleeve 23 and is slidably engaged therewith. A bobbin 27 on which the warp 2 has been wound is integrally rotatable with the sleeve 23. When the sleeve 23 is rotated against the shaft 22 in the direction of reeling off the warp 2, the twist spring 24 is screwed to accumulate the rotating power. The bobbin 27 and the sleeve 23 may be combined into an integral structure and the twist spring 24 may directly be engaged frictionally with the inner surface of a hole of the bobbin 27. When the warp 2 is reeled off from the bobbin 27, the sleeve 23 is rotated together with the supporter 25 against the shaft 22 so that the twist spring 24 which is normally unloaded is screwed to accumulate the rotating power.

When the amount of the warp 2 reeled off from the bobbin 27 exceeds a given limit, the rotation power accumulated in the twist spring 24 exceeds the friction power between the flat spring 26 and the inner surface of sleeve 23. The flat spring 26 is slipped against the sleeve 23 and only the sleeve 23 and the bobbin 27 are rotated, while the rotation of the supporter 25 is stopped. After that, the warp 2 can be taken out from the bobbin 27 under tension corresponding to the rotation power accumulated in the twist spring 24.

If the yarn 2 taken out from the bobbin 27 is loosened, the supporter 25 is rotated in the direction of winding the yarn 2 by the rotation power accumulated in the twist spring 24. This rotation is transmitted through the flat spring 26 to the sleeve 23 frictionally engaged with the flat spring 26. The bobbin 27 is rotated together with the sleeve 23 in the same direction and the loosened warps 2 is wound on the bobbin 27, whereby the loosening of warps 2 is dissolved.

The twist spring 24 eliminates a significant amount of loosening of the warp 2, but its function is not limited to that of removing loosening of the warps on the opening of the warps 2 as above mentioned. In case a problem occurred in the loom, the yarn 2 is temporarily pulled out significantly to repair the problem and then the pulled out yarn 2 can be rewound. However, removal of slight loosening of the yarn, such as loosening of the yarns on the opening of warps, can be made by other twist spring means, for example, a torsion bar.

Concerning the structure of the twist spring 24 frictionally engaged with the sleeve 23, the winding diameter at the end of the twist spring 24 can be enlarged so that the twist spring may directly engaged frictionally with the inner surface of the sleeve 23 and the supporter 25, and the flat spring 26 in the drawing can be omitted.

Figure 4B:
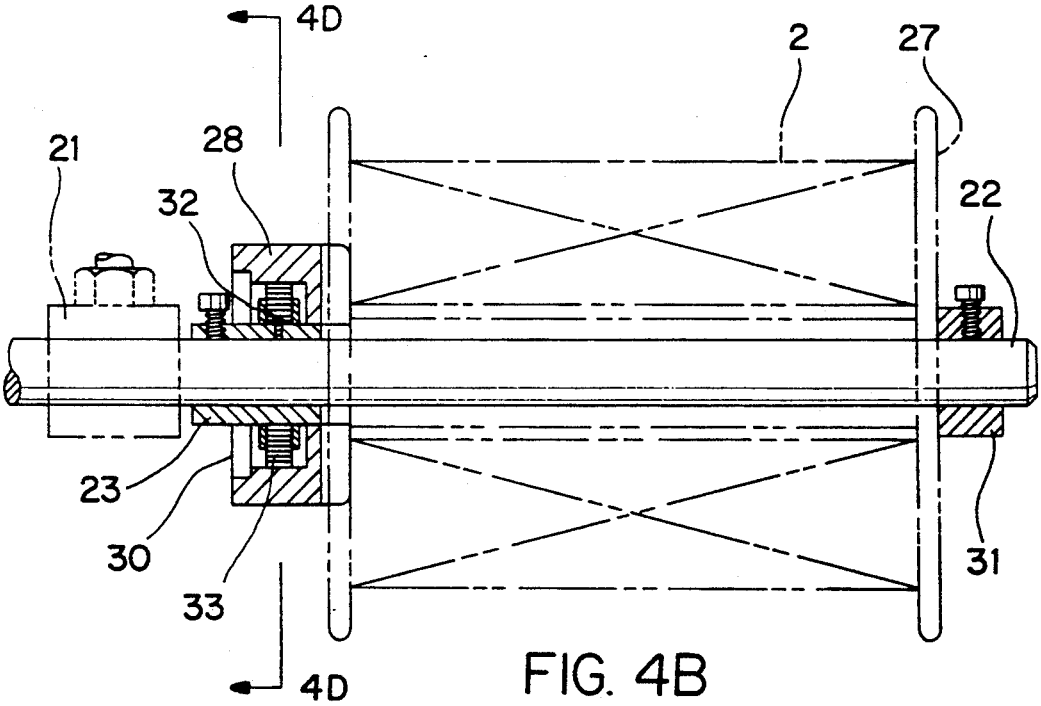
FIG. 4B illustrates an alternative embodiment of the warp-supplying device shown in FIG. 4A.
Figure 4C:
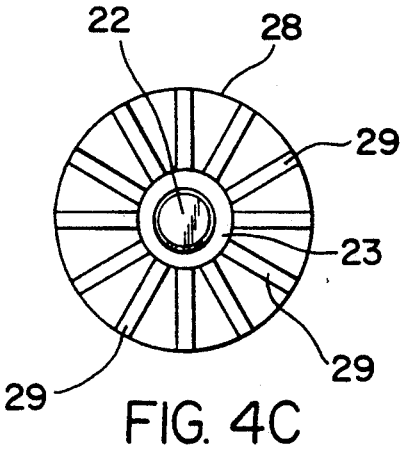
FIG. 4C is a top view of FIG. 4B.
Figure 4D:
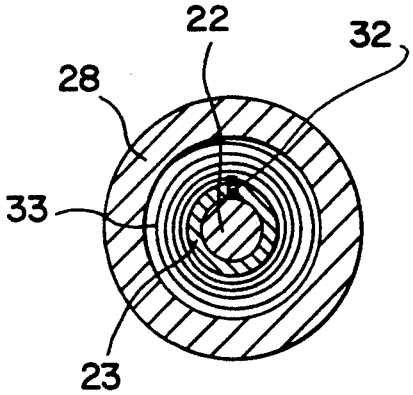
FIG. 4D is a cross-section view along line 4D—4D in FIG. 4B.

FIG. 4B is a longitudinal cross section of another example of the device for supplying the warps under tension to the circular loom. FIG. 4C is a top view of FIG. 4B and FIG. 4D is cross section cut along the line 4D—4E in FIG. 4B. As shown in FIG. 4A, a creel 21 of the warp-supplying device 2' is provided with a number of shafts 22. A spiral spring case 28 is mounted rotatably to the shaft 22. A side wall opposite to a bobbin 27 of the spiral spring case 28 is provided radially with a plurality of engaging grooves 29 engageable with the bobbin 27. The bobbin 27 winding the warp 2 thereon is mounted to the shaft 22 and one end of the bobbin 27 is engaged with the plurality of engaging grooves so as to rotate the spiral spring case 28 together with the bobbin 27. The opening of the spiral spring case 28 is closed with a cover 30 while a lock nut 31 is mounted to the shaft 22 adjacent to the bobbin so as to prevent the bobbin 27 from separating from the shaft 22. If desired, the shaft 22 is covered with a sleeve 23 and fixed with a pin 32. This sleeve 23 is conveniently provided to disconnect the spiral spring case 28 from the shaft 22. When the sleeve 23 is not used, a pin 32 is directly mounted to the shaft 22.

A spring 33 is inserted between the shaft 22 and the spiral spring case 28 as a means for accumulating spring power. The tip of the pin 32 is the letter "V" in cross section and this shape is easily engageable with the hole at the basal end of the spring 33 and hardly slipped out therefrom, and releases the engagement to allow racing when the shaft 22 is reversely rotated. The spring 33 is on one end engageable with the pin 32 and on the other end frictionally engageable with the inner wall of the spiral spring case 28 so that it is wound to accumulate the rotation power when the spiral spring case 28 is rotated against the shaft 22 in the direction of reeling off the warp.

The rotation power is imparted by reeling off the warps 2 to the bobbin 27 in the direction of rewinding the warp so that tension is imparted to the warp 2 and even if loosening of the warp takes place by the opening of the warps on weaving, the bobbin 27 is rotated to remove the loosening. In case the warp 2 is reeled off from the bobbin 27, it is rotated around the shaft 22 and the spiral spring case 28 is also rotated. As the spiral spring case 28 and the spring 33 are frictionally engaged, the spring 33 is wound with the rotation of the spiral spring case 28 at the initial stage of the rotation of the bobbin 27 to accumulate the rotation power.

When the amount of the warp reeled off from the bobbin 27 exceeds a given limit, the rotation power accumulated in the spring 33 exceeds the frictional power between the spring 33 and the inner surface of the spiral spring case 28, so that the spring 33 is slipped against the spiral spring case 28. Then the warp 2 can be taken out from the bobbin 27 under tension corresponding to the rotation power accumulated in the spring 33.

According to the warp-supplying devices shown in FIGS. 4A–4E, the warp 2 is always energized in the direction of rewinding and is always given a proper tension, and so it is not very likely that the yarn 2 will be loosened and contacted with other articles to cause abrasion or be caught by the loom.

Figure 5A:
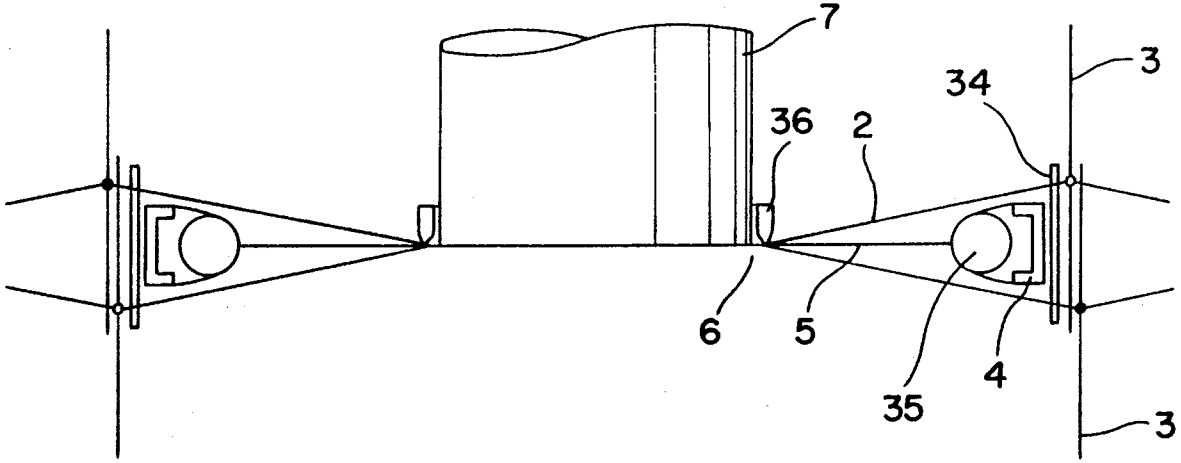
FIG. 5A PRIOR ART
FIG. 5A is illustrates a conventional circular loom.

FIG. 5A is a brief explanatory drawing showing a conventional circular loom. Reeds 34 are circularly arranged along the frame of a circular loom. Outside the reeds 34, heald 3 for opening the warps is also circularly arranged. A shuttle 4 is circularly moved inside of the reed 34 along the frame. A weft 5 is supplied from a bobbin 35 mounted to the shuttle 4 to a cloth fell below a cloth fell ring 36. From the warp-supplying devices, the warps 2 are passed between heald 3 and reeds 34 and supplied to cloth fell 6 below cloth fell ring 36. The warps are opened up and down and the shuttle 4 is passed through the opening between the warps 2 which is opened by the heald 3. At the cloth fell 6, the weft 5 is taken into the warps 2 to weave a tubular fabric 7.

Figure 5B:
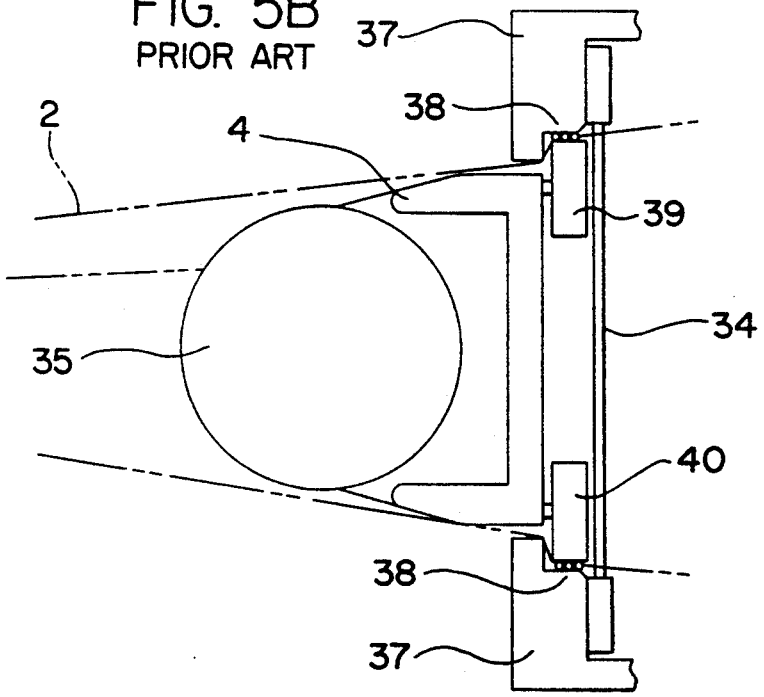
FIG. 5B PRIOR ART
FIG. 5B illustrates the shuttle portion of a conventional circular loom.

FIG. 5B is a cross section showing the shuttle portion of a conventional circular loom. Circular frames 37 are provided up and down and reed 34 is mounted therebetween. The reed 34 is provided inside with circular guide rails 38 facing up and down. The shuttle 4 is provided up and down with rotation rolls 39, 40 which move along the guide rails 38. In this case, the warps 2 are opened up and down by heald 3 and interposed between the guide rails 38 and the rotation rolls 39, 40, and the shuttle 4 is passed through this opening to weave the weft into the warps 2. In this structure, the warps 2 are considerably bent between the guide rails 38 and the rotation rolls 39, 40. If the warps are yarns of high strength and poor elongation, for example, yarns made of carbon fiber, glass fiber, aramide fiber, etc., the warps are damaged in this portion and cause trouble such as fluffing. When the warps 2 are in opened state, the route of the warps is longer than in the closed state so that the warps 2 are strained and stretched linearly from the heald 3 to the cloth fell 6. When such linearly stretched warps 2 are pressed between the guide rails 38 and the rotation rolls 39, 40, the warps are bent in that portion as shown in the drawing whereby a strong tension is imparted to the warps 2 even if the warps are bent slightly.

Furthermore, at the moment of pressing the warps 2 between the guide rails 38 and the rotation rolls 39 and 40, the warps 2 are fixed between the pressed portion and the cloth fell 6 so that an extremely strong tension is imparted to the warps. If the warps 2 in such state are contacted by the surface of the shuttle 4 or other portions, the warps 2 are very susceptible to abrasion and become fluffy.

Among the opened warps 2, especially the lower one receives the weight of the shuttle 4 and is strongly pressed between the lower rotation roll 40 and the guide rail 38. Thus, the warps become extremely fluffy.

Figure 5C:
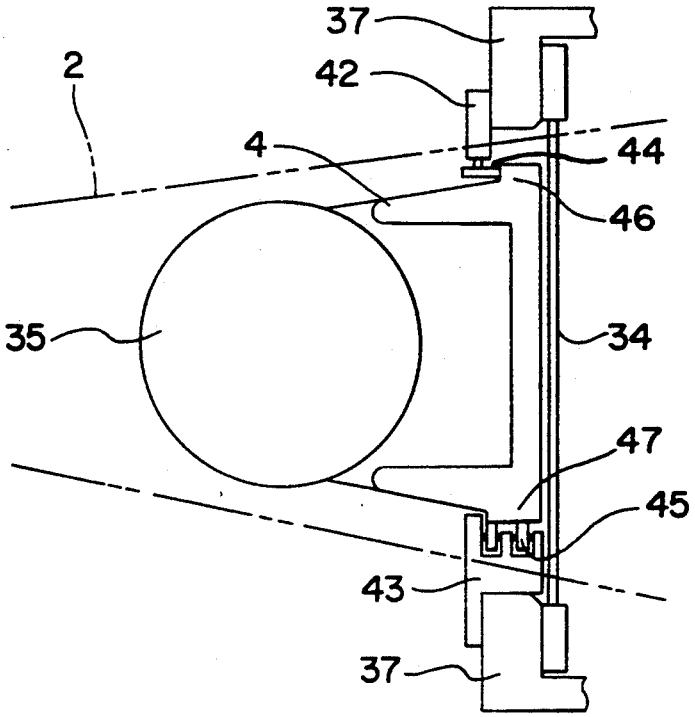
FIG. 5C illustrates the circular loom of the present invention.
Figure 5D:
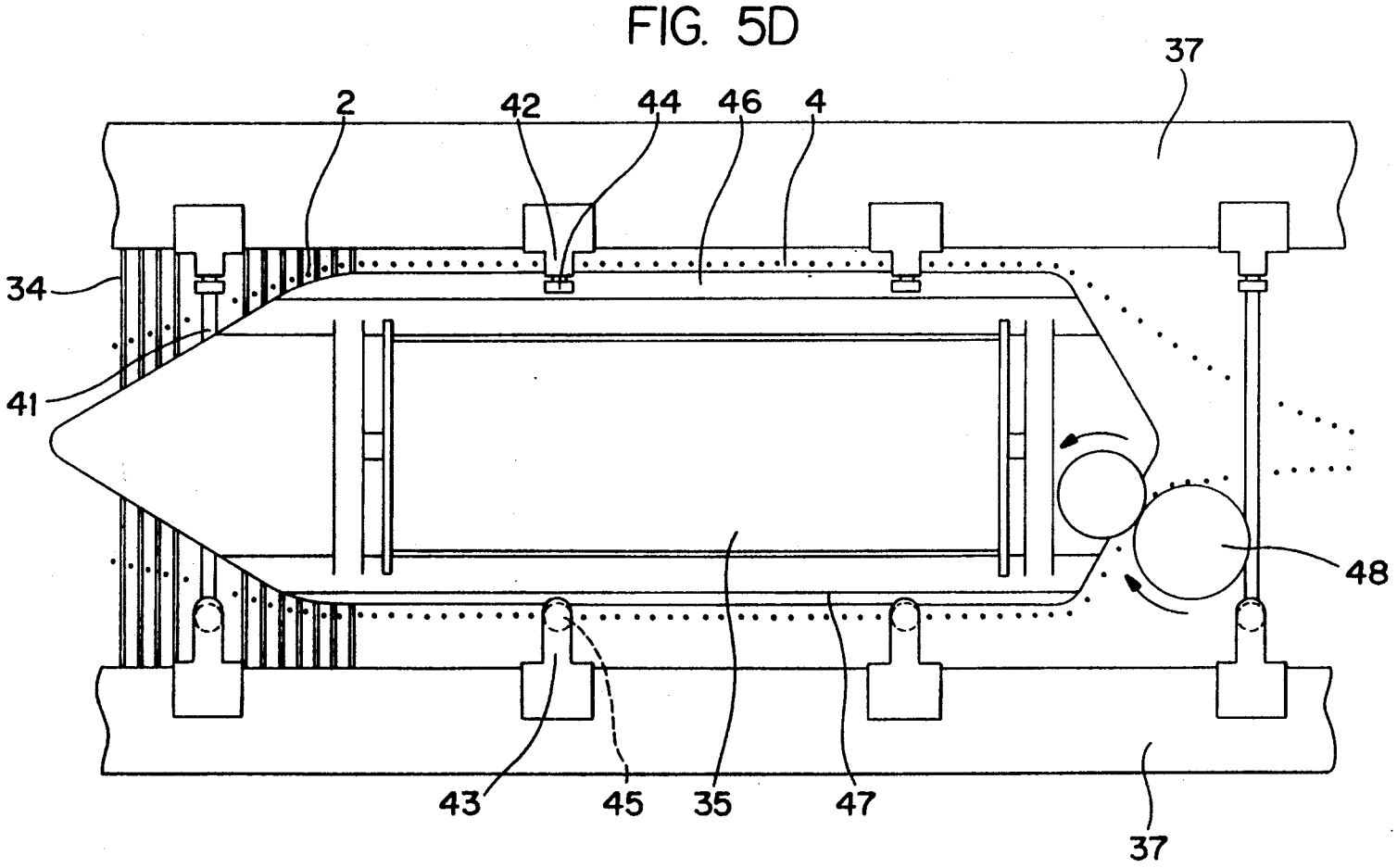
FIG. 5D illustrates the shuttle portion of the circular loom of the present invention.

FIG. 5C is a cross section showing the shuttle portion of the circular loom used in the present invention and FIG. 5D is an inside view showing that portion. In these drawings, a circular frames 37 are installed facing up and down as in the conventional loom. These frames are connected by connection frames 41 provided at an interval. A number of reeds 34 extending up and down are provided between these connection frames 41. The warps 2 are inserted between these reeds 34 and between the reed 34 and the connection frame 41. The path of the shuttle is formed inside of the frames 37, and supporting panels 42 and 43 of narrow width are mounted above and below a position corresponding to the connection frames 41. A supporting roll 44 rotatable in horizontal direction is mounted at the lower end of the upper supporting panel 42 while a supporting roll 45 rotatable around the diametrical axis of the circular loom as a rotation axis is mounted to the lower supporting panel 43.

The shuttle 4 is provided at the upper and the lower edges with guide parts 46 and 47 and is supported at the lower guide part 47 on a lower supporting roll 45 and at the upper guide part 46 on an upper supporting roll 44 so that the shuttle is prevented from falling inside of the circular loom. The shuttle is moved smoothly by rotating the supporting rolls 44 and 45 while being supported by the supporting panels 42 and 43. The length of the guide parts 46 and 47 is at least two times as much as the interval of the supporting panels 42 and 43.

In FIG. 5D, a pressing roll 48 is installed in the rear of the shuttle 4 and moved leftward in the drawing while rotating in the direction of the arrow whereby the shuttle 4 is pressed forward to move along its path.

According to the circular loom shown in FIG. 5C and 5D, the supporting panels 42 and 43 are provided in the position of the connecting frame 41 so that the warps 2 at the side of the connecting frame 41 are passed aside the supporting panels 42 and 43 in the state that the warps 2 are most opened. In this state, the shuttle 4 is passed between the opened warps 2. As the shuttle 4 is supported by the supporting panels 42 and 43 and the warps 2 is passed aside the supporting panels 42 and 43, the warps are not pressed between the shuttle 4 and the frame 37. The warps 2 may be contacted with the surface of the shuttle 4 depending on the use condition. However, the shuttle 4 is smoothly moved without any excessive tension so that the warps 2 are not worn or do not become fluffy.

After the shuttle 4 has been passed between the opened warps 2, the warps 2 are closed and passed between the shuttle 4 and the pressing roll 48, thus remaining behind. The shuttle 4 is pressed forward by the pressing roll 48 whereby the warps 2 are temporarily pressed between the shuttle 4 and the pressing roll 48. In this position, however, the opening of the warps 2 is almost closed and the route of the warps 2 is smaller than in the opened state so that tension is scarcely imparted to the warps 2. Even if the warps 2 are pressed between the shuttle 4 and the pressing roll 48, the route of the warps 2 is not bent and no tension is freshly applied to the warps, thus raising no problem.

It is preferable that the supporting panels 42 and 43 are mounted to a position corresponding to the connection frame 41, but a sufficiently thin supporting panels 42 and 43 may be mounted in a position corresponding to the reed 34. In this case, the supporting panels 42 and 43 may be mounted to the total reeds 34 or may be mounted at an interval of several reeds 34. When the supporting panels 42 and 43 are mounted in the position of the reed 34, the warps 2 passing between the narrow reeds 34 must be positioned on both sides of the supporting panels 42 and 43. Thus, the supporting panels 42 and 43 must be sufficiently thin. When the supporting rolls 44 and 45 are mounted to the supporting panels 42 and 43, a number of thin supporting panels 42 and 43 are arranged and the supporting rolls are allowed to abut against the edge portion of the supporting panels 42 and 43 for moving the shuttle 4. The supporting panels 42 and 43 are desirably mounted on the upper and lower parts of the path of the shuttle 4 as shown in the drawing, but they may be mounted on either of the upper and lower parts. Thus, the warps of high strength and poor elongation can smoothly be supplied to the circular loom without any damage.

According to the present invention, a long bias cloth of high quality using carbon fiber which cannot be manufactured according to the conventional technique can continuously be manufactured by using a combination of the warp-supplying device of the specific structure, the circular loom and the pillar cores. A long bias cloth of high quality obtained according to the present invention is useful as textile material and can be industrially useful in processed articles such as FRP, ACM, etc. by impregnation with various resins or rubbers. Further, it can be used for structural materials for ships and aircrafts or reinforcing materials having excellent quality. Furthermore, sporting goods can be manufactured utilizing the useful properties of lightweight and tough ACM processed articles.

The invention being thus described, it will be obvious that the present invention is not limited to the specific embodiments and modes as shown in the drawings and many wide modifications can be made. It is construed that such modification is intended to be included within the scope of this invention.

We claim:

1. A method for continuous manufacture of a long bias cloth comprising the steps of:

forming a tubular fabric by weaving warps and a weft on a circular loom, said circular loom having a central axis;

removing said tubular fabric from said circular loom along said central axis of the circular loom and under tension, while maintaining a cross-section of said tubular fabric in a circular on elliptical shape;

moving said tubular fabric in a lengthwise direction thereof along said central axis, while maintaining said cross-section in said circular or elliptical shape; and spirally cutting said tubular fabric during movement in said lengthwise direction along said central axis, by means of a cutter which moves in a circumferential direction transverse to said central axis, wherein said removing of the tubular fabric from said circular loom comprises the steps: (1) providing a primary pillar core oriented along said central axis, said primary pillar core having a circular or elliptical cross-section and an outer circumferential length slightly shorter than an inner circumferential length of said tubular fabric, said tubular fabric being slipped over said primary pillar core; and (2) providing a taking-out device having at least one stage and a plurality of caterpillars, said taking-out device being abutted against an outer periphery of said tubular fabric such that said tubular fabric is removed under tension from said circular loom and moved along an outer periphery of said primary pillar core by driving said caterpillars.

2. A method for continuous manufacture of a long bias cloth comprising the steps of:

forming a tubular fabric by weaving warps and a weft on a circular loom, said circular loom having a central axis;

removing said tubular fabric from said circular loom along said central axis of the circular loom and under tension, while maintaining a cross-section of said tubular fabric in a circular or elliptical shape;

moving said tubular fabric in a lengthwise direction thereof along a second axis, while maintaining said cross-section in said circular or elliptical shape, said second axis being different from said central axis; and spirally cutting said tubular fabric during movement in said lengthwise direction along said second axis, by means of a cutter which moves in a circumferential direction transverse to said second axis.

3. The method according to either claim 1 or 2, wherein said warps are supplied to said circular loom under tension at all times.

4. The method according to claim 3, wherein at least one of said warps or said weft is yarn of poor or low elongation.

5. The method according to claim 4, wherein said yarn of poor or low elongation is made of fibers selected from the group consisting of carbon fiber, glass fiber, aramide fiber and metal fiber.

6. The method according to claim 1, wherein said moving of the tubular fabric in a lengthwise direction thereof comprises the steps: (1) providing a secondary pillar core oriented along said central axis, said secondary pillar core having a cross-section similar to said cross-section of the primary pillar core and constructed integral with or separate from said primary pillar core, said tubular fabric being slipped over said secondary pillar core; and (2) providing a plurality of fed rolls, said feed roils being abutted against said outer periphery of said tubular fabric such that said tubular fabric is moved along in a lengthwise direction thereof and is simultaneously spirally cut by means of said cutter moving in said circumferential direction.

7. The method according to claim 2, wherein said moving of the tubular fabric in a lengthwise direction thereof comprises the steps: (1) providing a secondary pillar more oriented along said second axis, said secondary pillar core having an outer circumferential length slightly shorter than an inner circumferential length of said tubular fabric and having a circular or elliptical cross section, said secondary pillar core being inserted into said tubular fabric; and (2) providing a plurality of feed rolls such that said tubular fabric is advanced in a lengthwise direction thereof by said feed rolls, and is simultaneously spirally cut by means of said cutter moving in said circumferential direction.

8. The method according to either claim 6 or 7, wherein said tubular fabric being moved along in said lengthwise direction is externally cut spirally by said cutter installed on a turntable, said cutter moving in said circumferential direction at the same velocity as said turntable.

9. The method according to either claim 6 or 7, wherein said tubular fabric being moved along in said lengthwise direction is internally cut spirally by said cutter installed concealably at a position on an outer periphery of said secondary pillar core.

10. The method according to any one of claims 1, 2, 6, or 7, wherein said tubular fabric is moving in said lengthwise direction and said cutter is moving in said circumferential direction with both of said tubular fabric and said cutter moving at equal velocities.

11. An apparatus for continuous manufacture of a long bias cloth, comprising:

a warp-supplying device;

a circular loom for manufacturing a tubular fabric, said circular loom having a central axis, a circular frame, a plurality of reeds arranged on said frame, a shuttle for weft rotatable about said frame, said shuttle being supported by support panels located between a path of said shuttle and an opening path of warps supplied from said warp-supplying device;

a tubular fabric taking-out device for taking said tubular fabric out from said circular loom, said tubular fabric taking-out device comprising a primary pillar core arranged along said central axis of said circular loom, and a plurality of caterpillars arranged adjacent to an outer periphery of said primary pillar core;

a secondary pillar core and a plurality of feed rolls located adjacent an outer periphery of said secondary pillar core, for moving said tubular fabric forward in a lengthwise direction; and a cutter for spirally cutting said tubular fabric to form said long bias cloth, said cutter movable in a circumferential direction transverse to said lengthwise direction of said tubular fabric.

12. The apparatus according to claim 11, wherein at least one of said warps or said weft is yarn of poor or low elongation.

13. The apparatus according to claim 12, wherein said yarn of poor or low elongation is made of fibers selected from the group consisting of carbon fiber, glass fiber, aramide fiber and metal fiber.

14. The apparatus according to claim 11, wherein said primary pillar core and said secondary pillar core have outer circumferential lengths slightly shorter than an inner circumferential length of said tubular fabric and said primary pillar core and said secondary pillar core have circular or elliptical cross sections.

15. The apparatus according to either one of claims 11 or 12, wherein said primary pillar core and said secondary pillar core having the same shape.

16. The apparatus according to claim 11, wherein said circular loom and said cutting device are arranged on the same axis.

17. The apparatus according to claim 11 wherein said circular loom and said cutting device are arranged on different axes.

18. The apparatus according to claim 11, wherein said warp-supplying device comprises: a creel; a shaft fixed to said creel; and a bobbin supported by said shaft.

19. The apparatus according to claim 18, wherein said warp-supplying device further comprises: a sleeve rotatably mounted to said shaft; a spiral spring mounted between said shaft and said sleeve, one end of said spiral spring being fixed to said shaft and another end of said spiral spring frictionally engaging said sleeve; and said bobbin being mounted rotatably together with said sleeve.

20. The apparatus according to claim 18, wherein said warp-supplying device, further comprises: a pin provided with said shaft; a spiral spring case rotatably supporting said shaft; and a spring located between said shaft and said spiral spring case, one end of said spring being engageable with said pin and another end of said spring being frictionally engaged to said spiral spring case.

* * * * *